US012017328B2

(12) United States Patent
Kyoshima et al.

(10) Patent No.: US 12,017,328 B2
(45) Date of Patent: Jun. 25, 2024

(54) SYNTHETIC GRINDSTONE, SYNTHETIC GRINDSTONE ASSEMBLY, AND METHOD OF MANUFACTURING SYNTHETIC GRINDSTONE

(71) Applicant: TOKYO DIAMOND TOOLS MFG. CO., LTD., Tokyo (JP)

(72) Inventors: Kai Kyoshima, Tokyo (JP); Takeshi Yagi, Tokyo (JP)

(73) Assignee: TOKYO DIAMOND TOOLS MFG. CO., LTD., Tokyo (JP)

( * ) Notice: Subject to any disclaimer, the term of this patent is extended or adjusted under 35 U.S.C. 154(b) by 0 days.

(21) Appl. No.: 18/463,430

(22) Filed: Sep. 8, 2023

(65) Prior Publication Data

US 2024/0100653 A1 Mar. 28, 2024

(30) Foreign Application Priority Data

Sep. 28, 2022 (JP) ..... 2022-154610

(51) Int. Cl.
*B24D 3/22* (2006.01)
*B24D 18/00* (2006.01)

(52) U.S. Cl.
CPC ..... *B24D 3/22* (2013.01); *B24D 18/0009* (2013.01)

(58) Field of Classification Search
CPC ..... B24D 3/22; B24D 18/0009
See application file for complete search history.

(56) References Cited

U.S. PATENT DOCUMENTS

| | | | | |
|---|---|---|---|---|
| 6,679,758 | B2 | 1/2004 | Bright et al. | |
| 7,077,723 | B2 | 7/2006 | Bright et al. | |
| 7,422,513 | B2 | 9/2008 | Bright et al. | |
| 2003/0194947 | A1 | 10/2003 | Bright et al. | |
| 2004/0033766 | A1* | 2/2004 | Hokkirigawa | C09K 3/1409 451/177 |
| 2005/0101225 | A1 | 5/2005 | Bright et al. | |
| 2006/0160476 | A1 | 7/2006 | Bright et al. | |
| 2008/0293345 | A1 | 11/2008 | Bright et al. | |
| 2010/0037530 | A1 | 2/2010 | Yoshida et al. | |

(Continued)

FOREIGN PATENT DOCUMENTS

| | | | | |
|---|---|---|---|---|
| CN | 113788680 | * | 9/2021 | B24D 3/18 |
| CN | 113997213 | A | 2/2022 | |

(Continued)

OTHER PUBLICATIONS

Japanese Office Action dated Oct. 25, 2022 received in 2022-154610.

(Continued)

*Primary Examiner* — Pegah Parvini
(74) *Attorney, Agent, or Firm* — Scully, Scott, Murphy & Presser, P.C.

(57) ABSTRACT

A synthetic grindstone for performing surface processing includes: abrasive grains; a vitrified-material binder configured to retain the abrasive grains in a dispersed state; and a filler arranged in the binder in a dispersed state. The filler includes at least one of a first filler having an average grain size larger than an abrasive grain size of the abrasive grains, a second filler having an electrical conductivity, or a third filler having a hardness higher than a hardness of an object to be ground.

10 Claims, 3 Drawing Sheets

(56) References Cited

U.S. PATENT DOCUMENTS

| | | | | |
|---|---|---|---|---|
| 2014/0349557 | A1* | 11/2014 | Mizuno | B24D 5/06 451/542 |
| 2016/0361793 | A1 | 12/2016 | Oshima et al. | |
| 2021/0162564 | A1 | 6/2021 | Ito et al. | |
| 2021/0362298 | A1 | 11/2021 | Ogasawara et al. | |
| 2022/0023997 | A1 | 1/2022 | Kyoshima | |
| 2022/0088746 | A1 | 3/2022 | Tsuda | |

FOREIGN PATENT DOCUMENTS

| | | | |
|---|---|---|---|
| JP | H01-271177 | A | 10/1989 |
| JP | H06-226636 | A | 8/1994 |
| JP | 2004-050364 | A | 2/2004 |
| JP | 2004-087912 | A | 3/2004 |
| JP | 2008-137126 | A | 6/2008 |
| JP | 2009-034817 | A | 2/2009 |
| JP | 4573492 | B2 | 11/2010 |
| JP | 2013-188816 | A | 9/2013 |
| JP | 5640064 | B2 | 12/2014 |
| JP | 2017-001136 | A | 1/2017 |
| JP | 2017-047499 | A | 3/2017 |
| JP | 2019-093468 | A | 6/2019 |
| JP | 2019-141974 | A | 8/2019 |
| JP | 2019-177452 | A | 10/2019 |
| JP | 2019-181614 | A | 10/2019 |
| JP | 2021-008016 | A | 1/2021 |
| KR | 20110037806 | A | 4/2011 |
| KR | 101503545 | B1 | 3/2015 |
| WO | 2005/072912 | A1 | 8/2005 |

OTHER PUBLICATIONS

Korean Office Action dated Jan. 27, 2024 received in 10-2023-0123600.

European Search Report dated Feb. 14, 2024 received in 23195756.4.

* cited by examiner

| | | |
|---|---|---|
| Composition proportions [vol.%] | Abrasive grains | 0～50 |
| | Binder | 7～20 |
| | Pores | Rest |
| | First filler | 0～50 |
| | Second filler | 0～50 |
| | Third filler | 0～50 |

SYNTHETIC GRINDSTONE, SYNTHETIC GRINDSTONE ASSEMBLY, AND METHOD OF MANUFACTURING SYNTHETIC GRINDSTONE

CROSS-REFERENCE TO RELATED APPLICATIONS

This application is based upon and claims the benefit of priority from prior Japanese Patent Application No. 2022-154610, filed Sep. 28, 2022, the entire contents of which are incorporated herein by reference.

FIELD

The present invention relates to a synthetic grindstone, a synthetic grindstone assembly, and a method of manufacturing a synthetic grindstone for performing surface processing, such as chemo-mechanical grinding (CMG).

BACKGROUND

Surface processing may be performed by means of dry chemo-mechanical grinding (CMG) (e.g., Japanese Patent No. 4573492). In a CMG process, a synthetic grindstone obtained by fixing abrasives (abrasive grains) with a resin binder such as a thermoplastic resin is used. The synthetic grindstone is pressed against a wafer while the wafer and the synthetic grindstone are rotated (e.g., Japanese Patent KOKAI Publication No. 2004-87912). By being heated and oxidized by friction with the synthetic grindstone, convex portions on the surface of the wafer become brittle, and detach. In this manner, only the convex portions of the wafer are ground and planarized.

As a CMG process using a synthetic grindstone advances, for example, abrasive grains (abrasives) gradually detach from a surface (surface of action of mirror surface processing) of a binder of the synthetic grindstone facing an object to be ground, making the surface of action of the synthetic grindstone smooth. This increases the opportunity of contact between the binder, which is, for example, a thermoplastic resin, and the object to be ground at the surface of action.

SUMMARY

A synthetic grindstone for performing surface processing according to an embodiment of the present invention includes: abrasive grains; a vitrified-material binder configured to retain the abrasive grains in a dispersed state; and a filler arranged in the binder in a dispersed state. The filler includes at least one of a first filler having an average grain size larger than an abrasive grain size of the abrasive grains, a second filler having an electrical conductivity, or a third filler having a hardness higher than a hardness of an object to be ground.

DETAILED DESCRIPTION

Figure 1:
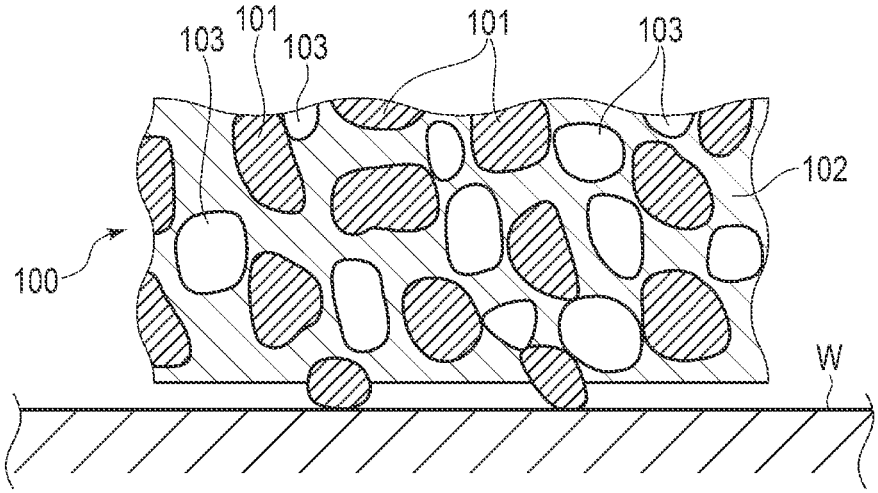
FIG. 1 is a schematic diagram showing a structure of a synthetic grindstone according to an embodiment.

As shown in FIG. 1, a synthetic grindstone 100 is includes abrasive grains (abrasives) 101 and a binder 102. The synthetic grindstone 100 may further include pores 103. In the synthetic grindstone 100 of the present embodiment, the abrasive grains 101 are dispersedly retained in the binder 102, and the pores 103 are dispersively disposed in the binder 102.

If an object to be ground is silicon, it is preferable, for example, that silica, a cerium oxide, or a mixture thereof be applied as the abrasive grains 101; however, the configuration is not limited thereto. Similarly, if an object to be ground is sapphire, it is preferable that a chromic oxide, a ferric oxide, or a mixture thereof, etc. be applied. Other applicable abrasives that may be used depending on the type of the object to be ground include alumina, silicon carbide, or a mixture thereof.

In the present embodiment, an example will be explained in which the object to be ground is silicon, and a cerium oxide with an average grain size of, for example, approximately 1 μm is used as the abrasive grains 101. The grain size of the abrasive grains 101 can be suitably set; however, it is preferable that it be, for example, smaller than 5 μm.

In the present embodiment, a vitrified material is used as the binder 102. Examples of the vitrified material that may be used include a hyaline material such as zinc borosilicate glass, borosilicate glass, aluminosilicate glass, soda-lime glass, and lead glass, and a ceramic material such as a porcelain material.

Figure 2:
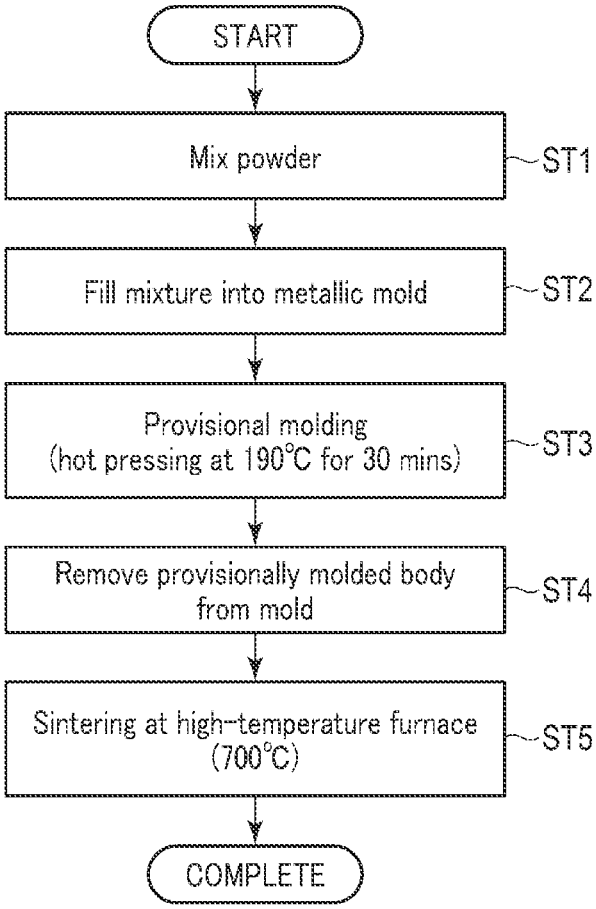
FIG. 2 is a schematic diagram showing a manufacturing flow (manufacturing method) of a synthetic grindstone (molded body).

The synthetic grindstone 100 is formed based on a flow (manufacturing method) shown in FIG. 2.

First, a mixed material (mixed powder) is obtained by mixing abrasive grains 101 with a vitrified-material binder 102 at volume proportions shown in FIG. 3, to be described later (step ST1). At this stage, the binder 102 is observed, not under magnification, in an approximately powder form.

Subsequently, the mixed material is filled into a metallic mold for forming the mixed material into a final shape of the synthetic grindstone 100 (step ST2). The synthetic grindstone 100 is pressure-molded (hot-pressed) at 190° C. for 30 minutes, for example, and is provisionally molded into a provisionally molded body (step ST3). Thereafter, the provisionally molded body is removed from the metallic mold (step ST4). After that, the provisionally molded body is sintered using a high-temperature furnace at, for example, 700° C., thereby obtaining the synthetic grindstone 100 (step ST5).

Figures 3, 4:
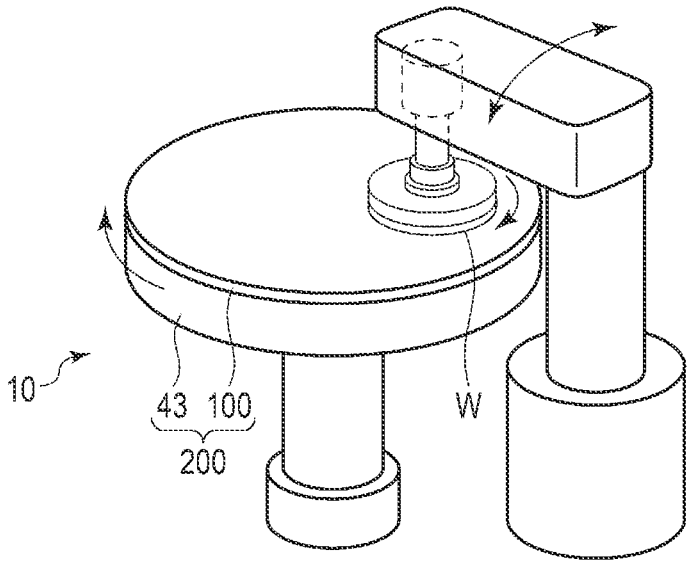
FIG. 3 shows volume proportions of abrasive grains, a binder, and a filler of a synthetic grindstone of a type produced using a vitrified material as a binder.
FIG. 4 is a schematic diagram showing a CMG device used for processing of an object to be ground.

FIG. 3 shows a table of compositions of the synthetic grindstone 100 produced with a vitrified bond, as described above.

As shown in FIG. 3, the abrasive grains 101 have an abrasive grain proportion (Vg) higher than 0 vol. % and equal to or lower than 50 vol. %. The binder 102 has a binder proportion (Vb) equal to or higher than 7 vol. % and equal to or lower than 20 vol. %. In the present embodiment, it is assumed that the abrasive grains 101 have an abrasive grain proportion (Vg) of 20 vol. %, the binder 102 has a binder proportion (Vb) of 7 vol. %, and the pores have a porosity (Vp) of 73 vol. %.

In the present embodiment, it is assumed that the synthetic grindstone 100 is formed in a disc shape and used in dry chemo-mechanical grinding (CMG) processing in which the synthetic grindstone 100 is processed by both a mechanical action and a chemical-component-based composition action. That is, the synthetic grindstone 100 exerts a dry chemo-mechanical grinding action on a surface of a wafer W, which is an object to be ground, and performs surface processing on the wafer W to be ground. Thereafter, a synthetic grindstone assembly 200 is formed by fixing the synthetic grindstone 100 to a grindstone retaining member (substrate) 43 with a double-sided tape, an adhesive, or the like, and is then attached to a CMG device 10 shown in FIG. 6 and used for surface processing of the wafer W to be ground. The grindstone retaining member 43 may be of any material which has a suitable stiffness that is resistant to CMG processing, which has a heat resistance up to a temperature that may be increased by use of the synthetic grindstone 100, and which is not thermally softened, and examples of such a material include an aluminum alloy material.

The wafer W to be ground is pressed against the synthetic grindstone 100 while the synthetic grindstone assembly 200, which includes the grindstone retaining member 43 and the synthetic grindstone 100, and the wafer W are rotated in an arrow direction shown in FIG. 4. At this time, the synthetic grindstone 100 is rotated at a circumferential velocity of, for example, 600 m/min, and the wafer W is pressed at a processing pressure of 300 g/cm$^2$. This allows the synthetic grindstone 100 and the surface of the wafer W to slidably move. After the processing starts, the synthetic grindstone 100 and the surface of the wafer W slidably move, and an external force acts on the binder 102. As the CMG process advances through a continuous action of the external force, abrasive grains (abrasives) gradually detach from a surface (surface of action of mirror surface processing) of the binder 102 of the synthetic grindstone 100 facing a surface of the wafer W to be ground. Through a chemo-mechanical grinding action of fixed abrasive grains 101 retained in the vitrified material used as the binder 102 or abrasive grains 101 dislodged out of the vitrified material, the surface of the wafer W is polished. By being heated and oxidized by friction with the synthetic grindstone 100, convex portions on the surface of the wafer W become brittle, and detach. In this manner, through grinding of only the convex portions on the surface of the wafer W, the surface of the wafer W is planarized.

In the present embodiment, a vitrified material is used as the binder 102 instead of using a thermoplastic resin material (e.g., ethyl cellulose) as a binder. Accordingly, the stiffness and the dimensional stability of the binder 102 can be increased compared to the case where a thermoplastic resin material is used as a binder. With such a configuration of the synthetic grindstone 100 according to the present embodiment, it is possible to suppress deformation at the time of processing, and to improve shape precision.

In the case of using a thermoplastic resin material as a binder, if heat accumulates between the synthetic grindstone and the wafer W, the thermoplastic resin material used as the binder is softened, thus causing smoothing at the surface of the synthetic grindstone. If the thermoplastic resin material used as the binder melts and adhesion to the surface of the wafer W, referred to as "sticking", occurs, a grinding resistance of the synthetic grindstone suddenly increases, possibly causing surface roughness and scratches of the wafer W.

On the other hand, in the case of using a vitrified material as the binder 102 as in the synthetic grindstone 100 according to the present embodiment, even if heat accumulates in the binder 102, smoothing at the surface of the synthetic grindstone 100 does not occur. It is thereby possible to prevent the binder 102 from being melted even if heat accumulates between the synthetic grindstone 100 and the wafer W. With such a configuration, the synthetic grindstone 100 according to the present embodiment can maintain stable processing properties for a longer period of time. It is thereby possible to prevent unintended scratches from occurring on the surface of the wafer W to be ground.

Behind this, the present inventors have made every effort to prevent occurrence of excessive frictional heat at the time of performing, for example, dry mirror surface processing, and discovered that a synthetic grindstone 100 formed based on the above-described volume proportions achieves excellent processing properties on the object to be ground. That is, a synthetic grindstone 100 preferable for performing dry surface processing includes, for example, abrasive grains 101 with an abrasive grain proportion (Vg) higher than 0 vol. % and equal to or lower than 50 vol. %, includes a vitrified-material binder 102 with a binder proportion (Vb) equal to or higher than 7 vol. % and equal to or lower than 20 vol. %. In the present embodiment, the abrasive grain proportion (Vg) is 7 vol. %, the binder proportion (Vb) is 20 vol. %, and the porosity (Vp) is 73 vol. %. By using the synthetic grindstone 100 according to the present embodiment, it is possible, at the time of performing, for example, dry mirror surface processing, to suppress excessive frictional heat from occurring between the synthetic grindstone 100 and the object to be ground, through the employment of a chemical solid-phase reaction that locally occurs under a high temperature and a high pressure between the synthetic grindstone 100 and the object to be ground. By performing, for example, dry mirror surface processing on the object to be ground using the synthetic grindstone 100 according to the present embodiment, it is possible to achieve processing (mirror surface processing) with extreme flatness, for example, with a surface roughness of the object to be ground on the sub-nanometer order.

According to the present embodiment, it is possible to provide a synthetic grindstone 100, a synthetic grindstone assembly 200, and a method of manufacturing the synthetic grindstone 100 capable of suppressing occurrence of excessive frictional heat at the time of performing, for example, dry mirror surface processing.

In the present embodiment, an example has been explained in which the synthetic grindstone 100 is provided in a disk shape. However, the synthetic grindstone 100 may also be formed in another shape such as a pellet shape or an elongated cuboid shape. The synthetic grindstone assembly 200 is formed in a suitable shape that retains the synthetic grindstone 100.

An example has been explained in which the synthetic grindstone 100 according to the present embodiment is used in dry processing; however, it may also be used in, for example, wet processing using grinding water (e.g., pure water).

(First Modification)

A case will be explained where a synthetic grindstone 100 according to the present modification contains, as a first filler, coarse particles with a suitable size.

It is preferable that the first filler be, for example, in a spherical shape; however, the first filler need not necessarily be in a spherical shape, and may be of any massive form with or without irregularities and/or deformations. The first filler is, for example, silica, and is dispersedly fixed by a binder 102 formed of a vitrified material. It is preferable that the first filler contain silica with a grain size larger than that of the abrasive grains 101, and silica with a smaller grain size fixed to the periphery of the silica with the larger grain size. It is preferable that the grain size of the silica with the smaller grain size be smaller than that of the abrasive grains 101. It is preferable that the first filler be at a volume proportion higher than 0 vol. % and equal to or lower than 50 vol. %.

The abrasive grains 101, which are formed of a cerium oxide, have a hardness equivalent to or lower than a wafer W to be ground, which is composed mainly of silicon, or an oxide thereof. As compared to the abrasive grains 101, the first filler, which is formed of silica, has a hardness equivalent to or lower than the wafer W, or an oxide thereof.

The synthetic grindstone 100 including the abrasive grains 101, the vitrified-material binder 102, and the first filler is manufactured as explained in the above-described embodiment.

Since the average grain size of the first filler is larger than that of the abrasive grains 101, the synthetic grindstone 100 and the wafer W are, during the processing, brought in near contact with each other via vertexes of the particles of the first filler. That is, since the first filler is present between a matrix (i.e., the abrasive grains 101 and the vitrified-material binder 102) of the synthetic grindstone 100 and the wafer W, the matrix and the wafer W are not brought in direct contact, and a certain clearance occurs.

If processing is started with the first filler being in contact with the wafer W, an external force acts on the matrix. Through a continuous action of the external force, the abrasive grains 101 are dislodged out of the matrix. The dislodged abrasive grains 101 are present at a processing interface in a state of adhering to the first filler in the clearance between the synthetic grindstone 100 and the wafer W. Accordingly, the abrasive grains 101 and the wafer W are, during the processing, brought in near contact with each other via vertexes of the particles of the first filler. Thereby, an actual contact area between the abrasive grains 101 and the wafer W becomes significantly small, thus increasing a working pressure at the point of processing. This advances the grinding processing with a high processing efficiency.

The clearance promotes replacement of air in the neighborhood of the surface of the wafer W with fresh air, thereby cooling the worked surface. Also, the sludge caused by the abrasive grains 101 is discharged from the wafer W to the outside via the clearance, thereby preventing the surface of the wafer W from being damaged. As a result, it is possible to prevent burns, scratches, etc. on the surface of the wafer W caused by frictional heat.

In this manner, the surface of the wafer W is ground with the synthetic grindstone 100 to have a planar surface with a predetermined roughness.

With the synthetic grindstone 100 according to the present modification, it is possible to maintain a high processing efficiency by maintaining a sufficient contact pressure between the abrasive grains 101 and the wafer W even in an advanced stage of the processing, and to prevent quality deterioration of the wafer W and occurrence of scratches by suppressing a direct contact between the binder 102 and the wafer W. In the present modification, with the heat generated between the synthetic grindstone 100 and the object to be ground, it is possible to suppress generation of excessive frictional heat, as explained in the above-described embodiment.

Examples of the first filler that may be applied include silica, silica gel (which is a porous body thereof), etc. For the first filler having an average grain size greater than the abrasive grains 101, a sintering method (see the flow shown in FIG. 5) by which carbon nanotubes, etc. are allowed to remain in the grindstone 101, as described in the second modification, may be used. Thereby, spherical activated carbon or spherical resin (which is formed into spherical carbon by being baked in an inert atmosphere), as well as an oxide such as silica or silica gel, may be used as the first filler.

(Second Modification)

A case will be explained where a synthetic grindstone 100 according to the present modification contains, as a second filler, an electrically conductive substance of a suitable size smaller than that of the first filler explained in the first modification. In the present modification, an example will be described in which an aluminum alloy material, for example, is used as a material of the grindstone retaining member 43 of the above-described CMG device 10 having an electrical conductivity and a suitable level of thermal conductivity.

Examples of the electrically conductive material include carbon nanotubes. Such a substance has an average grain size smaller than that of the abrasive grains 101. A volume proportion of the second filler in the synthetic grindstone 100 is set by a correlation with an abrasive grain proportion (Vg) of the abrasive grains 101 based on, for example, a binder proportion (Vb) of the binder 102. It is preferable that the second filler be added at a volume proportion higher than 0 vol. % and equal to or lower than 50 vol. %.

In the present modification, it is assumed that the synthetic grindstone 100 has such a composition that the abrasive grains 101 have an abrasive grain proportion (Vg) of 0.75 vol. %, the binder 102 has a binder proportion (Vb) of 7 vol. %, and the pores 103 have a porosity (Vp) of 66 vol. %, and the first filler is 26.25 vol. %.

By using, for example, carbon nanotubes as the second filler, the intensity of the synthetic grindstone 100 can be improved as a structure.

It is known that if carbon nanotubes used as the second filler are sintered in air, they might be burned down by reaction with oxygen.

Figure 5:
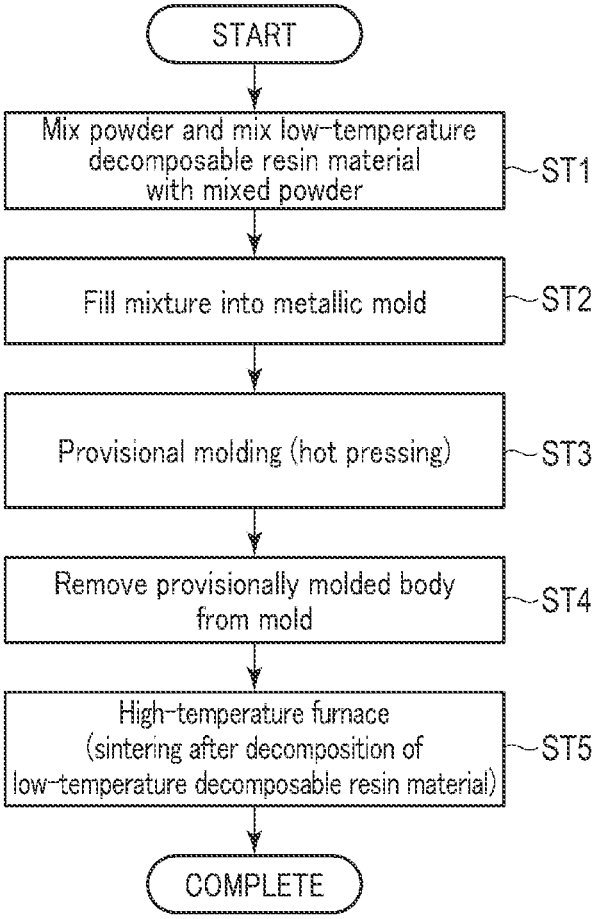
FIG. 5 is a schematic diagram showing a manufacturing flow (manufacturing method) of a synthetic grindstone (molded body) according to a second modification.

The synthetic grindstone 100 according to the present modification is formed based on the flow (manufacturing method) shown in FIG. 5.

First, a mixed material (mixed powder) is obtained by mixing the abrasive grains 101, the vitrified-material binder 102, and the second filler at the volume proportions shown in FIG. 3 (step ST1). At this time, as a resin material for the grindstone molding, a material (low-temperature decomposable resin material) that decomposes at a low temperature from 200° C. to 300° C., such as polyvinyl alcohol, is further mixed with the mixed material.

Subsequently, the mixed material is filled into a metallic mold to be formed into a final shape of the synthetic grindstone 100 (step ST2). The synthetic grindstone 100 is pressure-molded (hot-pressed) at 190° C. for 30 minutes, and is provisionally molded into a provisionally molded body (step ST3). Thereafter, the provisionally molded body is removed from the metallic mold (step ST4). After that, the provisionally molded body is retained for several hours in air for approximately 300° C. using, for example, a high-temperature furnace at a suitable temperature. Thereby, the low-temperature decomposable resin material decomposes, and after the decomposition is completed, an inert atmosphere such as a vacuum or a nitrogen atmosphere is created inside the high-temperature furnace, and the provisionally molded body is sintered to a temperature (700° C.) at which the vitrified-material binder becomes loose, while not burning down the carbon nanotubes. In this manner, the synthetic grindstone 100 is obtained (step ST5). At this time, by using a vacuum or an inert gas such as a nitrogen or argon gas as the sintering atmosphere, it is possible to prevent the second filler from being burned down. Also, the sintering temperature can be suitably set according to the required specifications of the vitrified bond.

As the processing of the wafer W is started with the CMG device 10, the synthetic grindstone 100 and the wafer W slidably move, thus causing an external force to act on the binder 102. Through a continuous action of the external force, the abrasive grains 101 are dislodged. The dislodged abrasive grains 101 slidably move through the clearance between the synthetic grindstone 100 and the wafer W. Through a chemo-mechanical grinding action of the abrasive grains 101, the surface of the wafer W is polished.

By a friction produced by the polishing of the surface of the wafer W, static electricity may occur on the surface of the wafer W. At this time, the second filler, which is electrically conductive, allows the static electricity on the surface of the wafer W to flow through the grindstone retaining member 43 (see FIG. 6). Accordingly, by using the synthetic grindstone 100 according to the present modification, static electricity occurring on the surface of the wafer W can be discharged while polishing the surface of the wafer W. As a result, it is possible to prevent adhesion of dust, etc. to the surface of the wafer W.

In the present modification, the grindstone retaining member 43 has a high thermal conductivity compared to the synthetic grindstone 100. By a friction produced by the polishing of the surface of the wafer W, frictional heat occurs on the surface of the wafer W. At this time, the frictional heat is absorbed by the second filler, and the heat absorbed by the second filler is conducted to the grindstone retaining member 43. Accordingly, by using the synthetic grindstone 100 according to the present modification, frictional heat occurring on the surface of the wafer W can be removed while polishing the surface of the wafer W. As a result, it is possible to prevent occurrence of burns on the surface of the wafer W caused by frictional heat between the surface of the synthetic grindstone 100 and the surface of the wafer W, and to prevent scratches. With the synthetic grindstone 100 according to the present modification, it is possible not only to provide preferable surface processing of the wafer W, but also to increase the lifespan of the synthetic grindstone 100.

It is also preferable that a heat dissipator such as heat radiation fins be provided on the grindstone retaining member 43, which rotates together with the synthetic grindstone 100; namely, it is preferable that the synthetic grindstone assembly 200 include a heat dissipator (heat transfer section). In this case, the heat dissipator is brought in contact with air through the rotation, causing the heat of the synthetic grindstone 100 to be effectively dissipated.

It is also possible to arrange water piping for cooling water in the grindstone retaining member 43, thereby cooling the grindstone retaining member 43 and the synthetic grindstone 100.

In the present modification, an example has been explained in which the grindstone retaining member 43 has an electrical conductivity and a higher thermal conductivity than that of the synthetic grindstone 100; however, the grindstone retaining member 43 may be formed of a material having at least one of an electrical conductivity or a thermal conductivity higher than that of the synthetic grindstone 100. In the case of the grindstone retaining member 43 having an electrical conductivity, it is possible to remove the static electricity between the object to be ground and the synthetic grindstone 100; in the case of the grindstone retaining member 43 having a thermal conductivity higher than that of the synthetic grindstone 100, it is possible to effectively dissipate heat that may occur in the synthetic grindstone 100.

In the first modification, an example has been explained in which the first filler is used, and in the second modification, an example has been explained in which the second filler is used. It is also preferable that the synthetic grindstone 100 include both the first filler and the second filler. In this case, the synthetic grindstone 100 is created in accordance with the flow shown in FIG. 5.

(Third Modification)

A case will be explained where a synthetic grindstone 100 according to the present modification contains, as a third filler, particles of a suitable size smaller than that of the first filler explained in the first modification.

Examples of the particles of the third filler include green carborundum (GC). Such particles have a hardness higher than the wafer W to be ground. The particles of the third filler such as GC may be greater than or smaller than an average grain size of the abrasive grains 101. As a matter of course, the particles such as GC may be of a size equivalent to the average grain size of the abrasive grains 101.

The average grain size of the abrasive grains 101 based on a metal oxide such as an aluminum oxide (alumina), a zirconium oxide (zirconia), a cerium oxide (ceria), and a silicon oxide (silica) may be greater than, smaller than, or equivalent to that of GC. For example, average grain sizes of the alumina-based, zirconia-based, and ceria-based abrasive grains 101 are mostly greater than that of GC. For example, the average grain size of alumina-based abrasive grains 101 may be equivalent to the size of GC (smaller than 200 nm). If, for example, the particle size of GC, etc. is 10 nm, the average grain size of the abrasive grains 101 based on silica, etc. may be 1 nm.

The synthetic grindstone 100 including the abrasive grains 101, the vitrified-material binder 102, and the third filler is manufactured, for example, as explained in the above-described embodiment (see FIG. 2).

A volume proportion of the third filler in the synthetic grindstone 100 is set by a correlation with an abrasive grain proportion (Vg) of the abrasive grains 101 based on, for example, a binder proportion (Vb) of the binder 102. It is preferable that the third filler be added at a volume proportion larger than 0 vol. % and equal to or smaller than 50 vol. %.

A technique (gettering effect) is known in which a gettering site such as fine flaws is formed on a back surface, opposite to a top surface, of the wafer W, and impurities are captured in the gettering site. GC, which has a hardness higher than the back surface of the wafer W, is used to intentionally make flaws on the back surface of the wafer W.

In the present modification, with the heat generated between the synthetic grindstone 100 and the object to be ground, it is possible to suppress generation of excessive frictional heat, as explained in the above-described embodiment. Since GC has electrical conductivity, it is possible to suppress static electricity that may occur between the synthetic grindstone 100 and the object to be ground.

In the first modification, an example has been explained in which the first filler is used, and in the second modification, an example has been explained in which the second filler is used. It is also preferable that the synthetic grindstone 100 include two or three of the first filler, the second filler, and the third filler. If all three filters are included, it is preferable, for example, that the abrasive grains 101 have an abrasive grain proportion higher than 0 vol. % and equal to or lower than 50 vol. %, a binder proportion is equal to or higher than 7 vol. % and equal to or lower than 20 vol. %, the first filler has a volume proportion higher than 0 vol. % and equal to or lower than 50 vol. %, the second filler has a volume proportion higher than 0 vol. % and equal to or lower than 50 vol. %, and the third filler has a volume proportion higher than 0 vol. % and equal to or lower than 50 vol. %. In this case, the synthetic grindstone 100 is created in accordance with the flow shown in FIG. 5.

The present invention is not limited to the above-described embodiments, and can be modified in various manners in practice, without departing from the gist of the invention. Moreover, the embodiments can be suitably combined; in such case, combined advantages are obtained. Furthermore, the above-described embodiments include various inventions, and various inventions can be extracted by a combination selected from structural elements disclosed herein. For example, if the problem can be solved and the effects can be attained even after some of the structural elements are deleted from all the structural elements disclosed in the embodiment, the structure made up of the resultant structural elements may be extracted as an invention.

What is claimed is:

1. A synthetic grindstone for performing surface processing, comprising:

abrasive grains having a hardness equivalent to or lower than a hardness of an object to be ground;

a vitrified-material binder configured to retain the abrasive grains in a dispersed state; and a filler arranged in the binder in a dispersed state, the filler including at least one of:

a first filler having an average grain size larger than an average grain size of the abrasive grains, the first filler having a hardness equivalent to or lower than the hardness of the object to be ground, or a second filler having an electrical conductivity.

2. The synthetic grindstone according to claim 1, wherein the abrasive grains have an abrasive grain proportion (Vg) higher than 0 vol. % and equal to or lower than 50 vol. %, the binder has a binder proportion (Vb) equal to or higher than 7 vol. % and equal to or lower than 20 vol. %, and each of the first filler, the second filler, and the third filler has a volume proportion equal to or higher than 0 vol. % and equal to or lower than 50 vol. %.

3. The synthetic grindstone according to claim 1, wherein a dry chemo-mechanical grinding action is exerted on the object to be ground.

4. A synthetic grindstone assembly comprising:

the synthetic grindstone according to claim 1; and a substrate to which the synthetic grindstone is fixed, the substrate having at least one of:

an electrical conductivity, or a thermal conductivity higher than a thermal conductivity of the synthetic grindstone.

5. A method for manufacturing the synthetic grindstone according to claim 1, comprising:

obtaining a mixed material by mixing the abrasive grains, the binder, and the filler;

filling the mixed material into a metallic mold and provisionally molding the mixed material by hot pressing;

removing, from the metallic mold, a provisionally molded body obtained by the provisional molding; and sintering the provisionally molded body with a high-temperature furnace, wherein the abrasive grains have an abrasive grain proportion (Vg) higher than 0 vol. % and equal to or lower than 50 vol. %, the binder has a binder rate (Vb) equal to or higher than 7 vol. % and equal to or lower than 20 vol. %, and each of the first filler, the second filler, and the third filler has a volume proportion equal to or higher than 0 vol. % and equal to or lower than 50 vol. %.

6. The method for manufacturing the synthetic grindstone according to claim 5, wherein the sintering of the provisionally molded body including the second filler using a high-temperature furnace includes sintering the provisionally molded body by creating an inert atmosphere inside the high-temperature furnace.

7. The method for manufacturing the synthetic grindstone according to claim 5, further comprising using the synthetic grindstone in dry chemo-mechanical grinding processing in which the synthetic grindstone is processed by both a mechanical action and a chemical-component-based composition action.

8. The method for manufacturing the synthetic grindstone according to claim 5, wherein the filler including at least one of the first filler, the second filler and a third filler having a hardness higher than a hardness of the object to be ground, and the method further comprising forming a gettering site having fine flaws on a back surface of the object to be ground.

9. The synthetic grindstone according to claim 1, wherein the filler including at least one of the first filler, or a second filler, and further including a third filler having a hardness higher than a hardness of the object to be ground.

10. The synthetic grindstone according to claim 1, wherein the object to be ground is composed mainly of silicon, or an oxide thereof.

* * * * *